US008237425B1

(12) United States Patent
Smith et al.

(10) Patent No.: US 8,237,425 B1
(45) Date of Patent: Aug. 7, 2012

(54) VOLTAGE REGULATOR WITH HIGH NOISE REJECTION

(75) Inventors: Mian Z. Smith, Los Altos, CA (US); Joseph Michael Ingino, Libertyville, IL (US)

(73) Assignee: Altera Corporation, San Jose, CA (US)

( * ) Notice: Subject to any disclaimer, the term of this patent is extended or adjusted under 35 U.S.C. 154(b) by 130 days.

(21) Appl. No.: 12/760,643

(22) Filed: Apr. 15, 2010

Related U.S. Application Data

(62) Division of application No. 11/441,849, filed on May 26, 2006, now abandoned.

(51) Int. Cl.
*G05F 3/16* (2006.01)
*G05F 1/40* (2006.01)

(52) U.S. Cl. ..... 323/314; 323/280; 327/539

(58) Field of Classification Search ..... 323/273–276, 323/278, 280, 281, 312–317; 327/538–543
See application file for complete search history.

(56) References Cited

U.S. PATENT DOCUMENTS

| | | | | |
|---|---|---|---|---|
| 5,512,814 | A * | 4/1996 | Allman | 323/267 |
| 6,114,844 | A * | 9/2000 | Chang et al. | 323/281 |
| 6,621,675 | B2 * | 9/2003 | Ingino, Jr. | 361/91.1 |
| 7,224,204 | B2 * | 5/2007 | Walter | 327/427 |
| 7,495,505 | B2 * | 2/2009 | Chang et al. | 327/539 |
| 7,602,101 | B2 * | 10/2009 | Hara et al. | 310/320 |

* cited by examiner

*Primary Examiner* — Jessica Han
(74) *Attorney, Agent, or Firm* — Ward & Zinna, LLC

(57) ABSTRACT

To improve noise rejection, a native (or undoped) NMOS transistor is used as a source follower in place of a conventional common source PMOS transistor in a voltage regulator circuit. The native transistor has a threshold voltage of approximately 0 volts which allows the maximum voltage output of the regulator to be higher by one threshold voltage of a conventional NMOS transistor than might be obtained from a voltage regulator that used a conventional NMOS transistor. Alternatively, a depletion transistor can be used to provide even higher output. In another illustrative embodiment, a conventional bandgap reference circuit is modified by replacing a common source transistor connected to the output of an op amp with a native MOS transistor connected as a source follower.

5 Claims, 6 Drawing Sheets

VOLTAGE REGULATOR WITH HIGH NOISE REJECTION

This application is a divisional of application Ser. No. 11/441,849, filed May 26, 2006 now abandoned, which is incorporated by reference herein.

FIELD OF THE INVENTION

This relates to a voltage regulator with high noise rejection. It is especially useful in a phase lock loop (PLL) power supply.

BACKGROUND OF THE INVENTION

FIG. 1 depicts a conventional voltage regulator 100 using an operational amplifier (op amp) and a common source transistor. The regulator comprises an op amp 110, a transistor 120, a compensation capacitor 130, and a voltage dividing feedback network 140. Transistor 120 is a PMOS transistor having a source 122, a gate 124 and a drain 126. Source 122 is connected to the voltage supply, Vcc, that is to be regulated and the regulated voltage, Vreg, is available at drain 126. Gate 124 is connected to the output of op amp 110. Power for the op amp is typically provided by the unregulated voltage supply, Vcc. The regulated voltage, Vreg, is divided by resistors 142, 144 in network 140 and the voltage at node 146 between resistors 142, 144 is applied to a non-inverting input terminal 112 of op amp 110. A reference voltage Vref is applied to an inverting input terminal 114 of the op amp 110.

In a practical application, transistor 120 is physically a relatively large device. Because of this size and the Miller effect, the gate-to-drain capacitance, Cgd, of this circuit is substantial. In addition, to ensure stability, the circuit requires compensation capacitor 130 to be connected across the gate and drain. As a result, the drain is strongly coupled to the gate and at high frequencies is coupled to the power supply, which greatly degrades the power noise rejection of the voltage regulator. In some applications, a common drain device may be used as a source follower to improve noise rejection but this results in a much reduced regulator output.

Power supply noise is often the major cause of jitter in the output clock of a phase lock loop (PLL). To minimize the PLL's sensitivity to noise, it is desirable to regulate the power supply to the analog circuit blocks of the PLL which are extremely sensitive to noise.

SUMMARY OF THE PRESENT INVENTION

In accordance with the invention, a native MOS transistor is used as a source follower in place of a conventional common source MOS transistor in a voltage regulator circuit. The native transistor has a threshold voltage of approximately 0 volts which allows the maximum voltage output of the regulator to be higher by approximately the threshold voltage of a conventional NMOS transistor, e.g., 0.7 volts, than the maximum voltage output that might be obtained from a voltage regulator that used a conventional NMOS transistor. Alternatively, a depletion transistor can be used to achieve even higher output voltage for a given supply voltage.

In a first illustrative embodiment of the invention, the regulator comprises an op amp, a native NMOS transistor connected as a source follower to an output of the op amp, a compensation capacitor connected between the output of the op amp and ground, a current leaker resistor connected between the regulated output and ground, a decoupling capacitor connected between the regulated output and ground and a feedback network for supplying a portion of the regulated output voltage to an inverting input of the op amp. Because the source follower is not subject to the Miller effect and because the compensation capacitance for the regulator stability is placed between the gate of the source follower and the ground, in contrast to placing it between the gate and the drain in a common source device, the power noise rejection of this regulator is superior to the conventional regulator using a PMOS common source transistor.

In a second illustrative embodiment of the invention, the op amp of the voltage regulator is operated as a unity gain buffer. For this purpose, the regulated output voltage is fed back unattenuated to the inverting input terminal of the op amp. In other respects, the circuit of this embodiment is the same as that of the first embodiment. The unity gain buffer can also be combined with the first illustrative embodiment so that the regulated output voltage of the first illustrative embodiment is supplied to the non-inverting input terminal of the op amp of the unity gain buffer. In this arrangement, the output of the two voltage regulators will track each other while the outputs are isolated from each other.

In a third illustrative embodiment, a conventional bandgap reference circuit is modified by replacing a common source transistor connected to the output of an op amp with a native NMOS transistor connected as a source follower. As is known in the art, a bandgap reference circuit generates a fixed DC reference voltage that remains substantially constant with variations in temperature. It achieves this constant output by adding two quantities which have opposite temperature coefficients (TCs) with proper weighing, to result in a zero TC. Illustratively, in the third illustrative embodiment, an op amp is used to sense the voltage difference of two forward-biased base-emitter junctions and the output of the op amp is provided to a native transistor connected as a source follower, and to the base-emitter junctions through resistors. Since the forward-biased base-emitter voltage exhibits a negative TC while the voltage difference between two base-emitter junctions operating at unequal current densities has a positive TC, these effects can be offset to produce an output voltage that is substantially constant with variations in temperature. Advantageously, the bandgap reference circuit of the present invention can be combined with the first illustrative embodiment so that the output voltage of the bandgap reference circuit is supplied as an input to the non-inverting input terminal of the op amp of the first illustrative embodiment.

BRIEF DESCRIPTION OF THE DRAWINGS

These and other objects, features and advantages of the present invention will be more readily apparent from the following Detailed Description in which.

DETAILED DESCRIPTION

Figure 1:
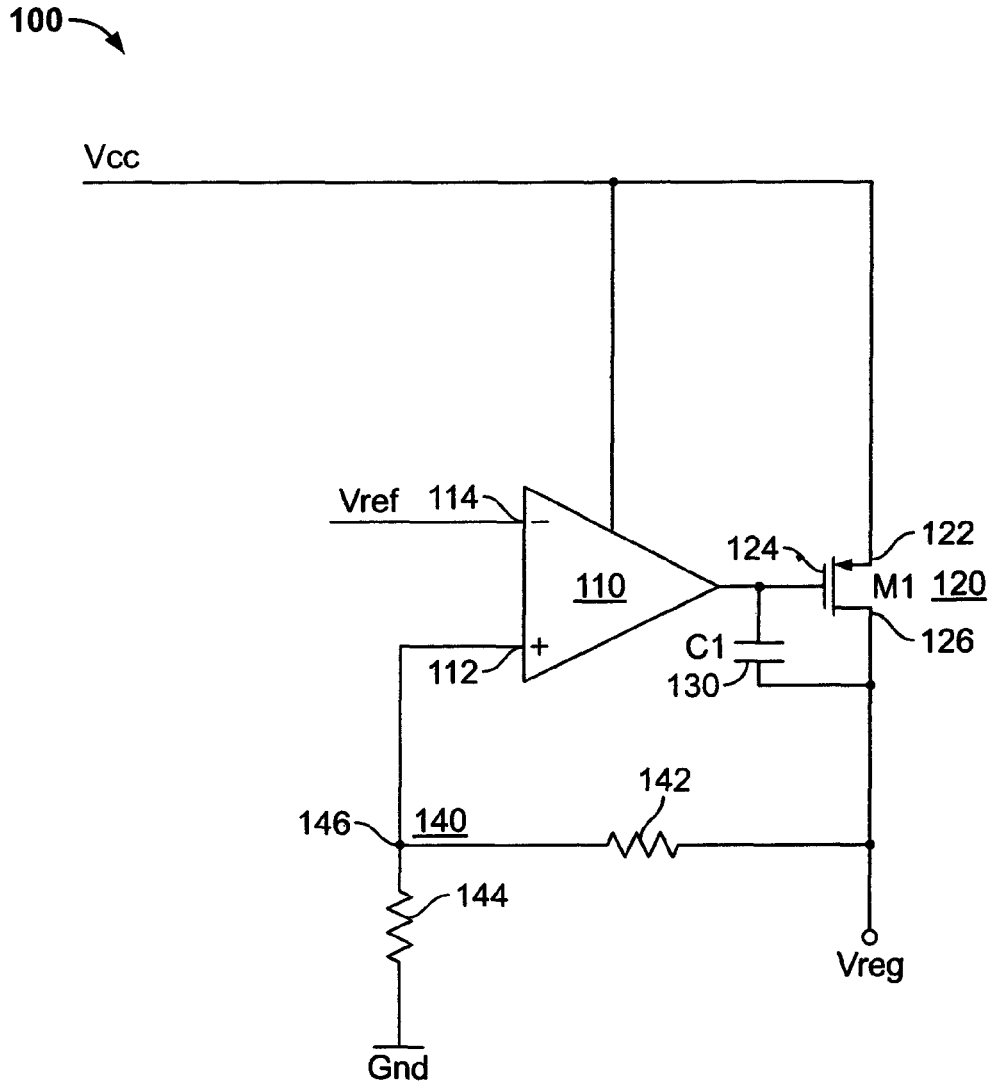
Figure 1 (Prior Art)
FIG. 1 is a schematic diagram of a prior art voltage regulator.
Figure 2:
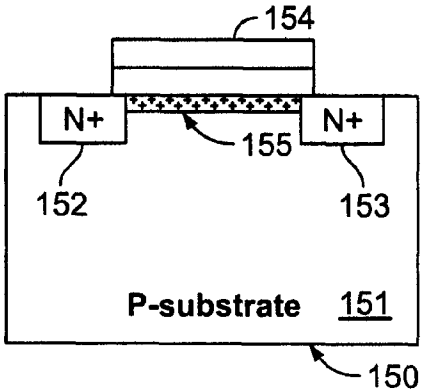
FIGS. 2, 3 and 4 depict a conventional NMOS device, a native NMOS device and a depletion mode NMOS device and their characteristic current-voltage plots.
Figure 2:
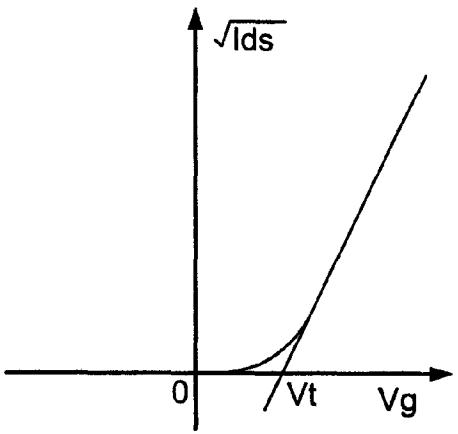
Figure 3:
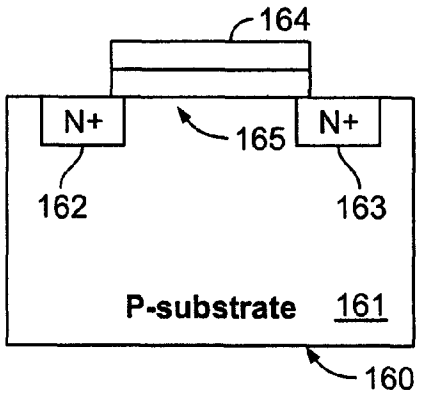
Figure 3:
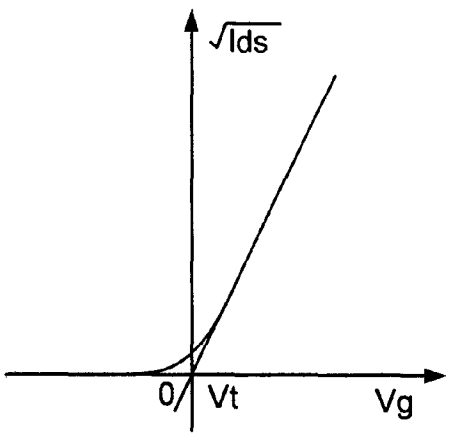
Figure 4:
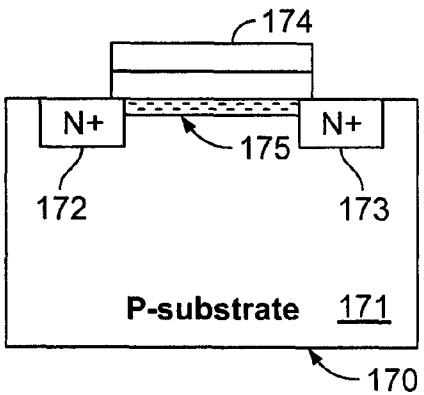
Figure 4:
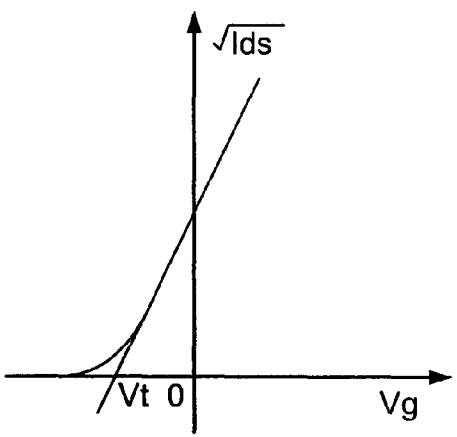

FIGS. 2, 3 and 4 illustrate the basic differences among a conventional NMOS device 150, a native NMOS device 160, and a depletion NMOS device 170.

Conventional NMOS device 150 of FIG. 2 comprises a p-type substrate 151, drain and source N+ regions 152, 153, and a polysilicon gate 154. NMOS device 150 has a threshold voltage implant region 155 in its channel region beneath gate 154 between N+ drain/source regions 152 and 153. Region 155 is a shallow region implanted with p-type dopants during the fabrication process. Region 155 increases the threshold voltage of NMOS device 150 by removing negative charge carriers from the channel. As a result, the threshold voltage of NMOS device 150 is greater than zero (e.g., +0.7 volts) as shown in graph 158, when its source voltage is zero volts.

Native n-channel NMOS device 160 of FIG. 3 comprises a p-type substrate 161, drain/source N+ regions 162, 163, and a polysilicon gate 164. Native NMOS device 160 does not have a threshold voltage implant in its channel region beneath the gate. As a result, the doping level in the channel region beneath the gate is the same as it is elsewhere in the substrate. The threshold voltage of native device 160 is approximately zero volts as shown in graph 168 when its source voltage is zero volts.

Depletion NMOS device 170 of FIG. 4 comprises a p-type substrate 171, drain and source N+ regions 172, 173, and a polysilicon gate 174. Device 170 has a threshold voltage implant region 175 in its channel region beneath gate 174 between N+ drain/source regions 172 and 173. Region 175 is a shallow region implanted with n-type dopants during the fabrication process. Region 175 reduces the threshold voltage of device 170 by adding additional negative charge carriers into the channel. As a result, the threshold voltage of device 170 is less than zero (e.g., −0.3 volts) as shown in graph 178, when its source voltage is zero volts. Further information about depletion transistors may be found, for example, at A. S. Sedra & K. C. Smith, *Microelectronic Circuits*, pp. 318-321 (3rd ed., Saunders 1991).

As the source voltage of an NMOS device increases, the threshold voltage of the NMOS device also increases (but not in proportion the source voltage). If the source voltage of depletion NMOS device 170 increases sufficiently, its threshold voltage rises above zero. However, the threshold voltage of depletion NMOS device 170 is less than the threshold voltage of native NMOS device 160 at the same source voltage.

Figure 5:
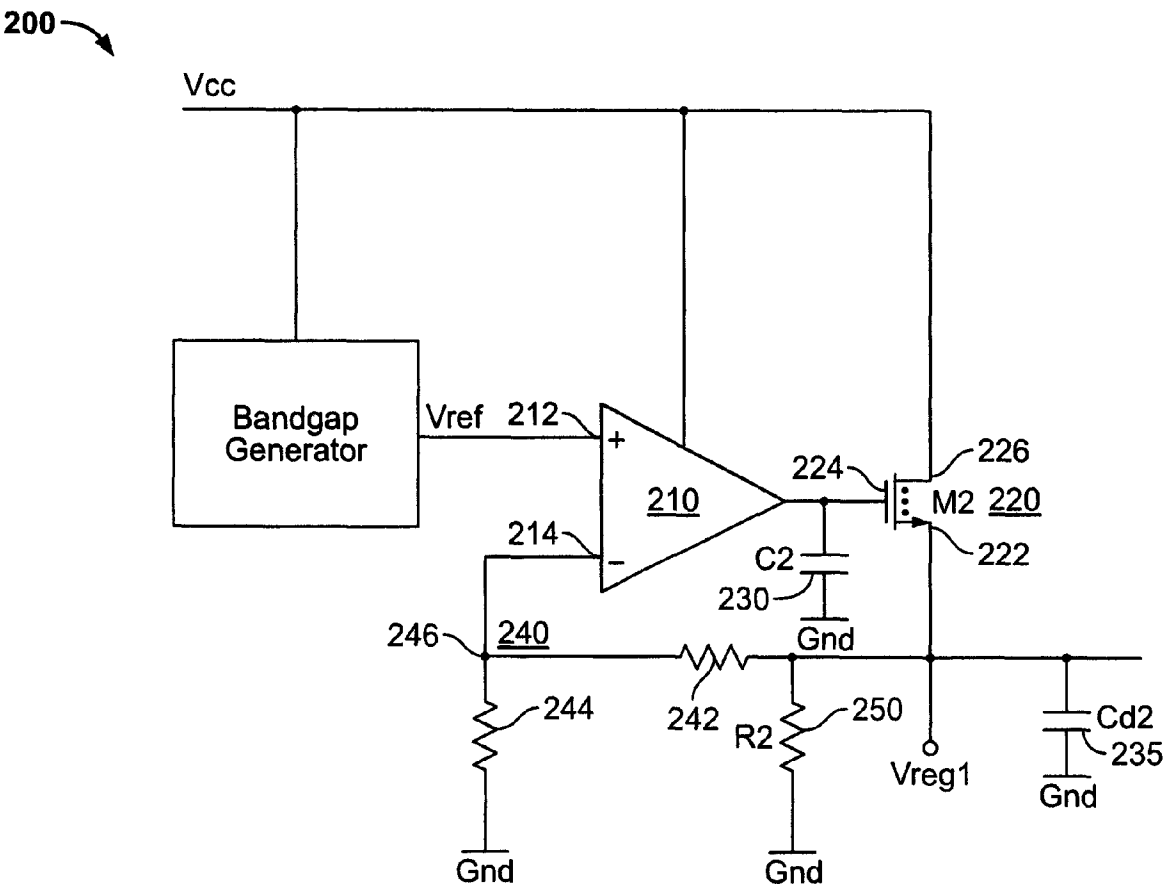
FIG. 5 is a schematic diagram of a first illustrative embodiment of the invention.
Figure 7:
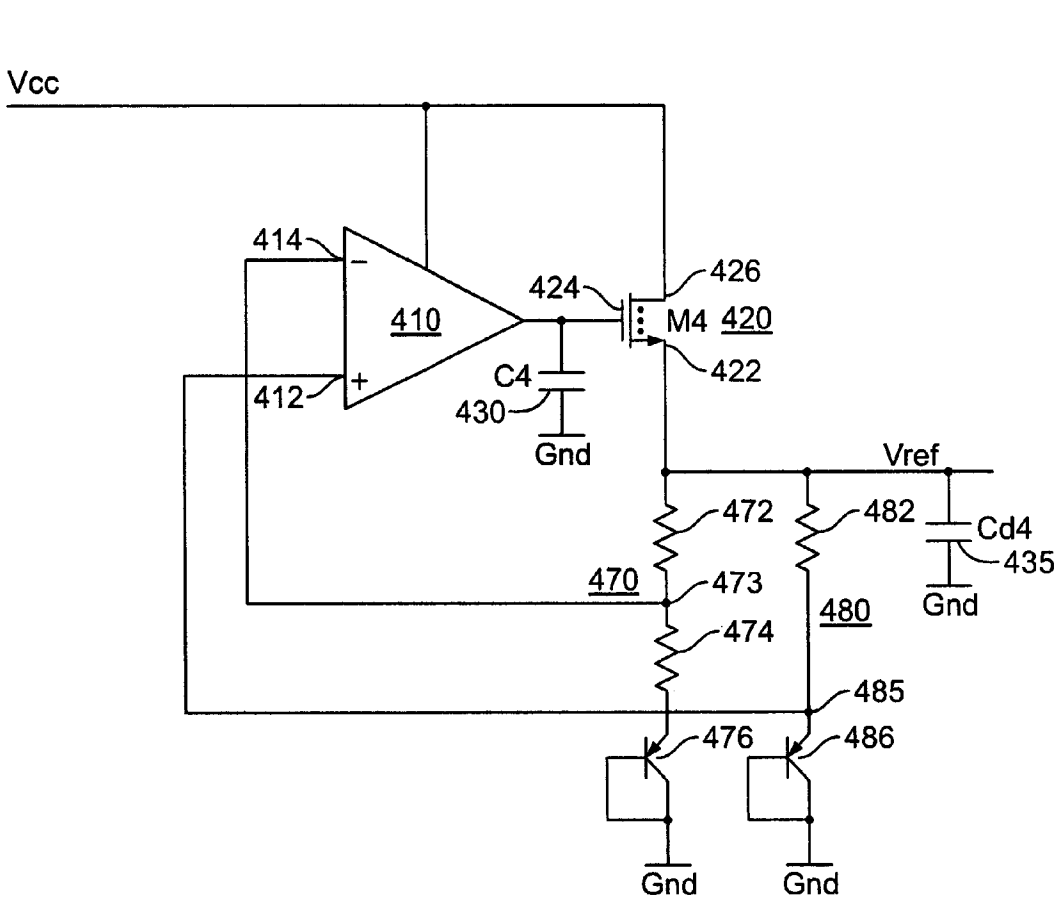
FIG. 7 is a schematic diagram of a third illustrative embodiment of the invention.

FIG. 5 depicts a first embodiment of a voltage regulator 200 of the present invention. The regulator comprises an operational amplifier (op amp) 210, a transistor 220, first and second capacitors 230, 235, a voltage dividing feedback network 240 and a current leaker resistor 250. Transistor 220 is a MOS transistor having a source 222, a gate 224 and a drain 226. Drain 226 is connected to the voltage supply, Vcc, that is to be regulated and the regulated voltage, Vreg1, is available at source 222. Gate 224 is connected to the output of op amp 210. Power for the op amp is typically provided by the unregulated voltage supply, Vcc. A reference voltage Vref is applied to a non-inverting input terminal 212 of the op amp 210. Illustratively, the reference voltage is supplied by a bandgap reference circuit which can be a conventional circuit or, preferably, a circuit as shown in FIG. 7. The regulated voltage, Vreg, is divided by resistors 242, 244 in network 240 and the voltage at node 246 between resistors 242, 244 is applied to an inverting input terminal 214 of op amp 210.

In accordance with the invention, transistor 220 is a native NMOS transistor. As a result, the threshold voltage at which the transistor begins to conduct between source and drain is approximately 0 volts. Since the threshold voltage of transistor 220 is approximately 0 volts, the maximum regulator output voltage of voltage regulator 200 is higher by approximately one conventional NMOS threshold voltage, typically 0.7 volts, than the maximum output voltage that would be provided by a voltage regulator using a conventional NMOS transistor source follower.

Alternatively, transistor 220 is a depletion NMOS transistor such as that shown in FIG. 4 in which a channel of n-type conductivity has been physically implanted between the source and drain. Since the threshold voltage for a depletion NMOS transistor is negative, the use of a depletion transistor can produce a higher regulated output voltage and/or permit the use of a lower unregulated supply voltage.

Capacitor 230 is connected between the output of op amp 210 and ground and current leaker resistor 250 is connected between the regulated output and ground. Capacitor 230 and current leaker 250 are used to provide stability over the range of operating conditions. Advantageously, the current leaker can be a current source device in which the current drawn is inversely proportional to the current drawn by the load. This is especially advantageous in reducing the burden on the regulator where the load is a phase lock loop operating at high frequencies. Capacitor 235 is a decoupling capacitor connected between the regulated output and ground and providing further decoupling between the regulated output and the unregulated voltage supply.

Figure 6:
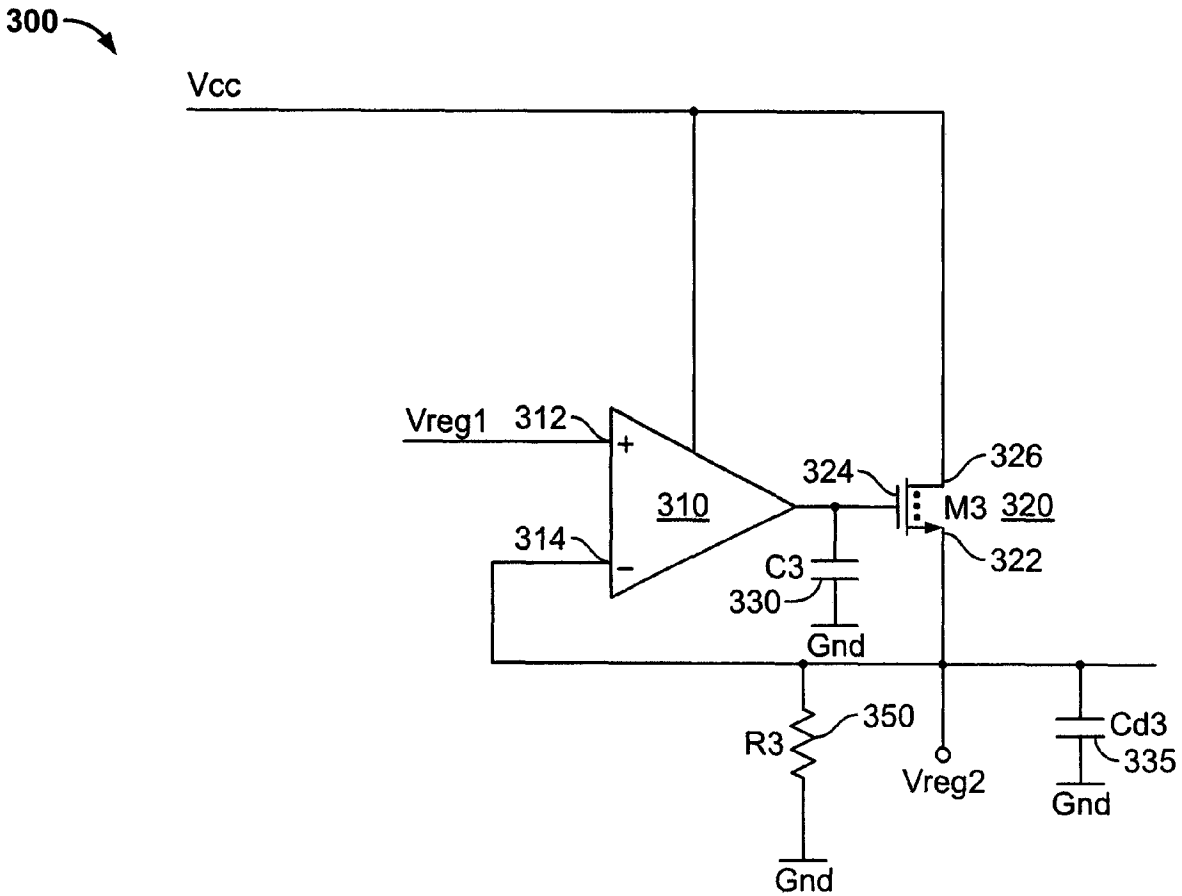
FIG. 6 is a schematic diagram of a second illustrative embodiment of the invention.

FIG. 6 depicts a second embodiment of a voltage regulator 300 of the present invention. It is essentially the same as the circuit of FIG. 5 but the op amp is configured as a unity gain buffer. The regulator comprises an operational amplifier (op amp) 310, a transistor 320, first and second capacitors 330, 335 and a current leaker resistor 350. Transistor 320 is a MOS transistor having a source 322, a gate 324 and a drain 326. Drain 326 is connected to the voltage supply, Vcc, that is to be regulated and the regulated voltage, Vreg2, is available at source 322. Gate 324 is connected to the output of op amp 310. Power for the op amp is typically provided by the unregulated voltage supply, Vcc. A reference voltage Vreg1 is applied to a non-inverting input terminal 312 of the op amp 310. The regulated voltage, Vreg2, is applied without attenuation to an inverting input terminal 314 of op amp 310. Preferably, transistor 320 is a native NMOS transistor. Alternatively, it is a depletion NMOS transistor.

Advantageously, the voltage regulators of FIGS. 5 and 6 are combined so that the reference voltage Vreg1 that is supplied to the non-inverting input terminal 312 of op amp 310 of voltage regulator 300 is the regulated output voltage Vreg1 produced at source 222 of voltage regulator 200. In such arrangement, the regulated output voltages of the two voltage regulators will track each other while maintaining noise isolation from each other. Thus, the output from regulator 200 can be used to provide power to noise sensitive analog circuits of a phase lock loop (PLL) circuit while the output from regulator 300 can be used to supply power to the noisy parts of the PLL circuit.

FIG. 7 depicts a third embodiment of the present invention in the form of a bandgap reference circuit 400. In this embodiment, a conventional bandgap reference circuit is modified by replacing a common source transistor connected to the output of an op amp with a native MOS transistor connected as a source follower. Detailed descriptions of bandgap reference circuits may be found in P. Horowitz & W. Hill, *The Art of Electronics*, pp. 335-339 (2d ed., Cambridge 1989); T. H. Lee, *The Design of CMOS Radio-Frequency Integrated Circuits*, pp. 227-235 (Cambridge, 1998); and B. Razavi, *Design of Analog CMOS Integrated Circuits*, pp. 381-385 (McGraw-Hill, 2000), which are incorporated herein by reference. Bandgap reference circuit 400 comprises an operational amplifier (op amp) 410, a transistor 420, first and second capacitors 430, 435, a first temperature dependent circuit 470 and a second temperature dependent circuit 480. Transistor 420 is a MOS transistor having a source 422, a gate 424 and a drain 426. Drain 426 is connected to the voltage supply, Vcc, that is to be regulated and the regulated voltage, Vreg, is available at source 422. Gate 424 is connected to the output of op amp 410. Power for the op amp is typically provided by the unregulated voltage supply, Vcc.

The first temperature dependent circuit 470 comprises a series connection of first and second resistors 472, 474 and a bipolar transistor 476 in which the base and collector are coupled together and connected to ground. The second temperature dependent circuit 480 comprises a series connection of a resistor 482 and a bipolar transistor 486 in which the base and collector are coupled together and connected to ground. The output voltage, Vref, is connected to resistors 472 and 482. A node 473 between resistors 472 and 472 is connected to a inverting input terminal 414 of op amp 410. A node 485 between resistor 482 and transistor 486 is connected to a non-inverting input terminal 412 of op amp 410.

Bipolar transistor 476 comprises several unit transistors in parallel and transistor 486 is a single unit transistor. As a result, transistors 476 and 486 operate at different collector current densities. Op amp 401 amplifies the difference between the voltages at nodes 473 and 485 in circuits 470 and 480 and provides an output to transistor 420. The difference between the voltages at the emitters of transistors 476 and 486 has a positive temperature coefficient (TC). However, the base-emitter voltage between ground and node 485 of transistor 486 exhibits a negative temperature coefficient. The positive TC and negative TC are added with proper weighting by op amp 401, source follower 420 and resistors 472, 473 and 482. The resulting reference voltage, Vref, at node 422 is substantially constant with variations in temperature, thereby displaying substantially zero TC.

Figure 8:
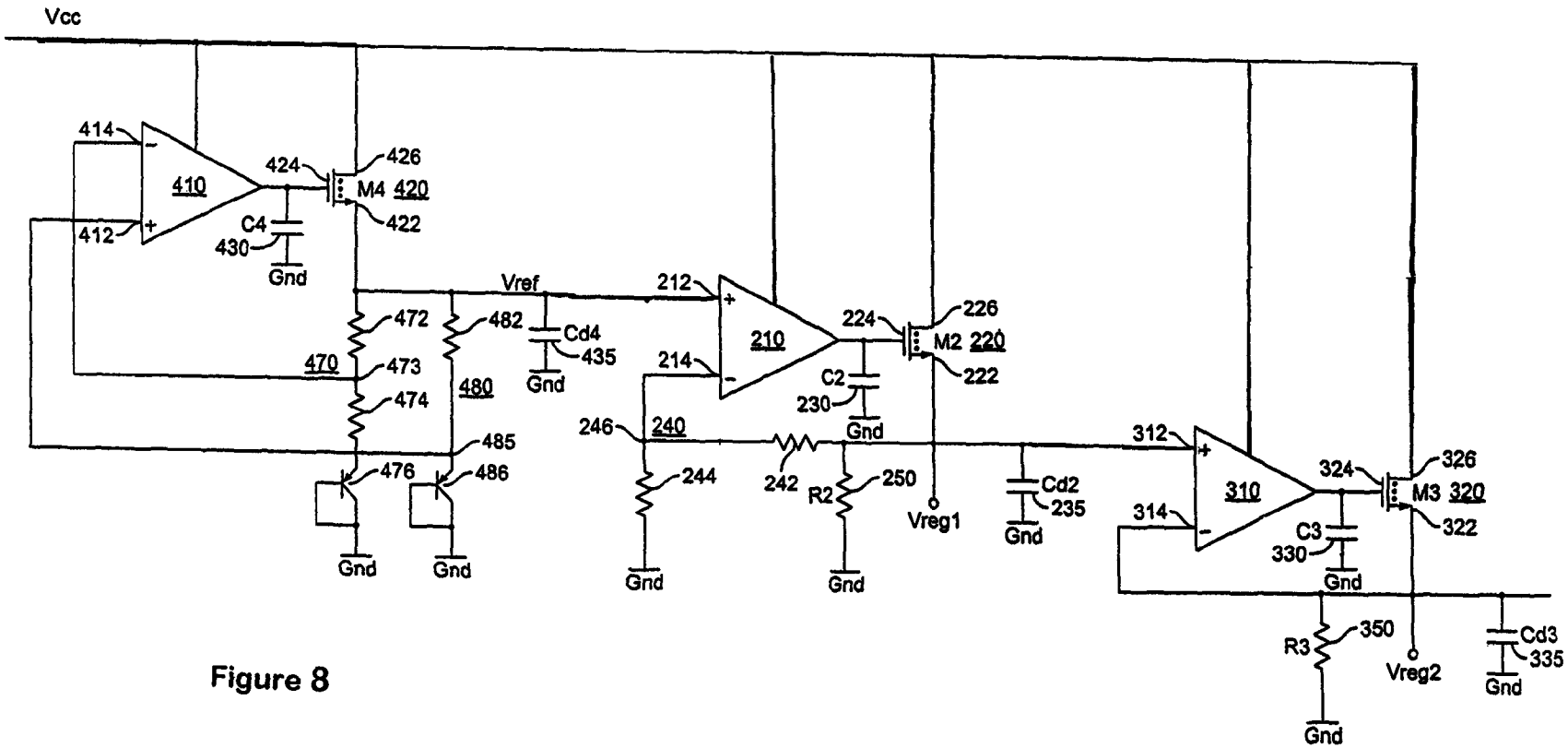
FIG. 8 is a schematic diagram of a fourth illustrative embodiment of the invention.

As indicated above, bandgap reference circuit 400 is advantageously combined with the voltage regulator 200 so that the output voltage, Vref, available at source 422 is supplied to the non-inverting input terminal 212 of op amp 210; and the voltage regulators 200 and 300 may also be combined. The resulting voltage regulator depicted in FIG. 8 includes:

a first operational amplifier 410;

a first native NMOS transistor 420 having a first source 422, a first drain 426 and a first gate 424, the gate being coupled to an output of the first operational amplifier, an unregulated supply voltage being applied to the first drain and a first regulated voltage being provided at the first source;

a first temperature dependent circuit 470 coupled to the source and having an output coupled to an inverting input 414 of the first operational amplifier;

a second temperature dependent circuit 480 coupled to the source and having an output coupled to a non-inverting input 412 of the first operational amplifier;

a second operational amplifier 210 having a non-inverting input 212 coupled to the first source 422;

a second native NMOS transistor 220 having a second source 222, a second drain 226 and a second gate 224, the second gate being coupled to an output of the second operational amplifier, the voltage to be regulated being applied to the second drain and a second regulated voltage being provided at the second source;

a feedback path 240 between the second source and an inverting input 214 of the second operational amplifier;

a third operational amplifier 310 having a non-inverting input 312 coupled to the second source 222;

a third native NMOS transistor 320 having a third source 322, a third drain 326 and a third gate 324, the third gate being coupled to an output of the third operational amplifier, the voltage to be regulated being applied to the third drain and a third regulated voltage being provided at the third source; and a feedback path between the third source 322 and an inverting input of the third operational amplifier 314.

As will be apparent to those skilled in the art, numerous variations may be practiced within the spirit and scope of the invention. Of particular note, as indicated above, a depletion transistor may be substituted for the native transistor.

What is claimed is:

1. A voltage regulator comprising:

a first operational amplifier;

a first native NMOS transistor having a first source, a first drain and a first gate, the gate being connected to an output of the first operational amplifier, an unregulated supply voltage being applied to the first drain and a first regulated voltage being provided at the first source, a first temperature dependent circuit connected to the source and having an output connected to an inverting input of the first operational amplifier;

a second temperature dependent circuit connected to the source and having an output connected to a non-inverting input of the first operational amplifier;

a second operational amplifier having a non-inverting input connected to the first source;

a second native NMOS transistor having a second source, a second drain and a second gate, the second gate being connected to an output of the second operational amplifier, the voltage to be regulated being applied to the second drain and a second regulated voltage being provided at the second source, a feedback path between the second source and an inverting input of the second operational amplifier, a third operational amplifier having a non-inverting input connected to the second source;

a third native NMOS transistor having a third source, a third drain and a third gate, the third gate being connected to an output of the third operational amplifier, the voltage to be regulated being applied to the third drain and a third regulated voltage being provided at the third source; and a feedback path between the third source and an inverting input of the third operational amplifier.

2. A voltage regulator comprising:

a first operational amplifier;

a first native NMOS transistor having a first source, a first drain and a first gate, the gate being connected to an output of the first operational amplifier, an unregulated supply voltage being applied to the first drain and a first regulated voltage being provided at the first source, a first temperature dependent circuit connected to the source and having an output connected to an inverting input of the first operational amplifier;

a second temperature dependent circuit connected to the source and having an output connected to a non-inverting input of the first operational amplifier;

a second operational amplifier having a non-inverting input connected to the first source;

a second native NMOS transistor having a second source, a second drain and a second gate, the second gate being connected to an output of the second operational amplifier, the voltage to be regulated being applied to the second drain and a second regulated voltage being provided at the second source, and a feedback path between the second source and an inverting input of the second operational amplifier.

3. The voltage regulator of claim 2 wherein the first and second temperature dependent circuits each comprises at least one resistor connected in series with a bipolar transistor.

4. The voltage regulator of claim 3 wherein each bipolar transistor has a base and collector that are connected to ground.

5. The voltage regulator of claim 3 wherein the first temperature dependent circuit comprises at least two resistors connected in series and the output is connected to a node between the two resistors.

* * * * *